US005898937A

United States Patent [19]

Sullivan

[11] Patent Number: 5,898,937

[45] Date of Patent: May 4, 1999

[54] TOTAL IMPACT FOREARM AND HAND SHIELD

[76] Inventor: Steven A. Sullivan, 1717 Harman St., Ridgewood, N.Y. 11385

[21] Appl. No.: 08/999,182

[22] Filed: Dec. 29, 1997

[51] Int. Cl.[6] ..... A41D 13/08

[52] U.S. Cl. ..... 2/16; 2/161.6

[58] Field of Search ..... 2/16, 17, 158, 2/159, 160, 161.1, 161.6, 59, 167

[56] References Cited

U.S. PATENT DOCUMENTS

| | | | |
|---|---|---|---|
| 792,475 | 6/1905 | Sullivan | 2/16 |
| 3,746,356 | 7/1973 | Shipstad | 2/16 |
| 4,213,205 | 7/1980 | Smith | 2/16 |
| 4,272,849 | 6/1981 | Thurston et al. | 2/16 |
| 4,657,282 | 4/1987 | Koch | 2/16 |
| 5,491,840 | 2/1996 | Yen | 2/16 |
| 5,737,771 | 4/1998 | Aanonsen | 2/16 |

*Primary Examiner*—John J. Calvert
*Assistant Examiner*—Larry D. Worrell, Jr.
*Attorney, Agent, or Firm*—Otho B. Ross

[57] ABSTRACT

The present invention comprises a one-piece, lightweight shield for covering the top half of a person's forearm and the entire hand made into a fist clenched around a chisel or other tool. An opening is formed in the shield near the hand end to allow the tool to be grasped by the person's hand while wearing the shield. Straps are provided to attach the shield to the forearm. The shield may be made of shatter-resistant plastic or other durable, lightweight material.

1 Claim, 2 Drawing Sheets

FIG. 1
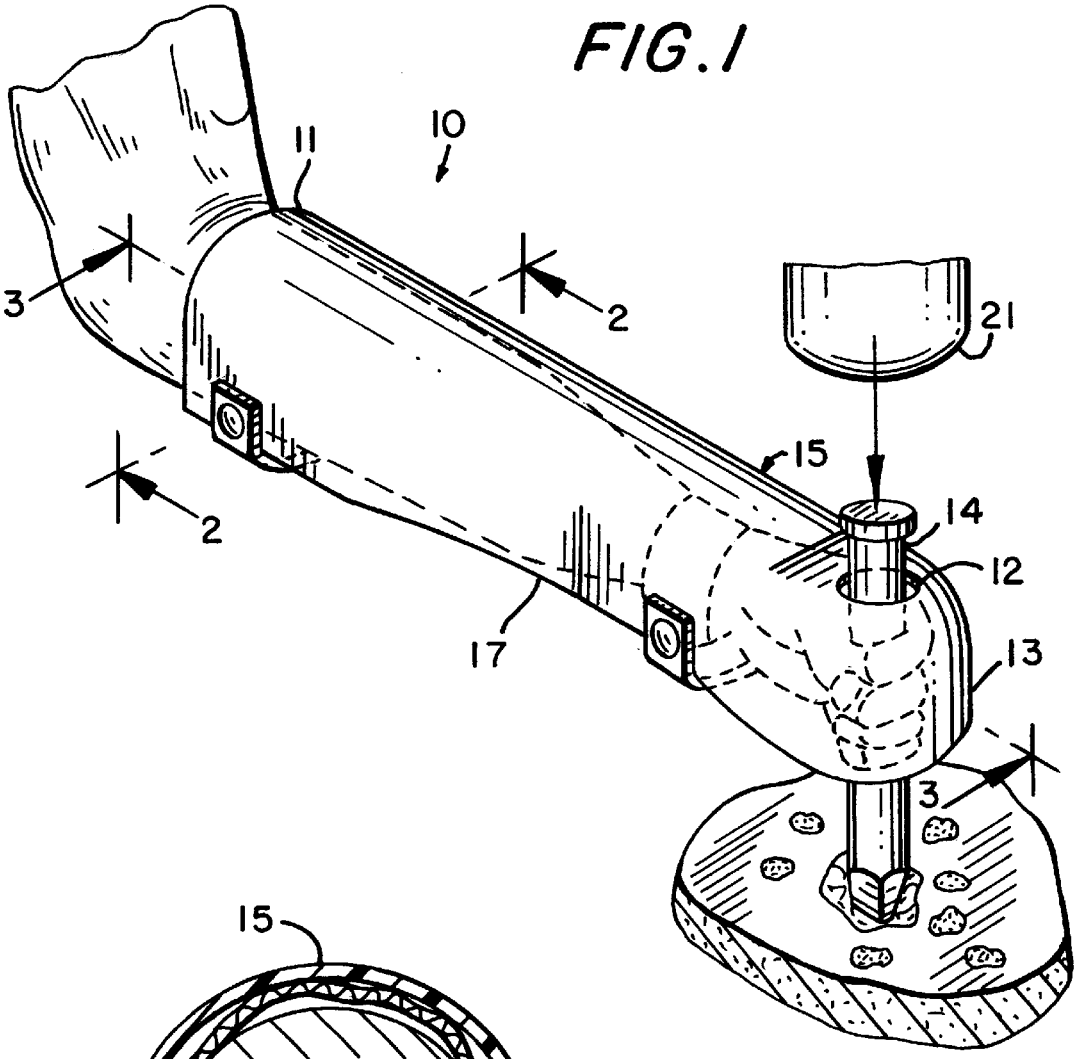
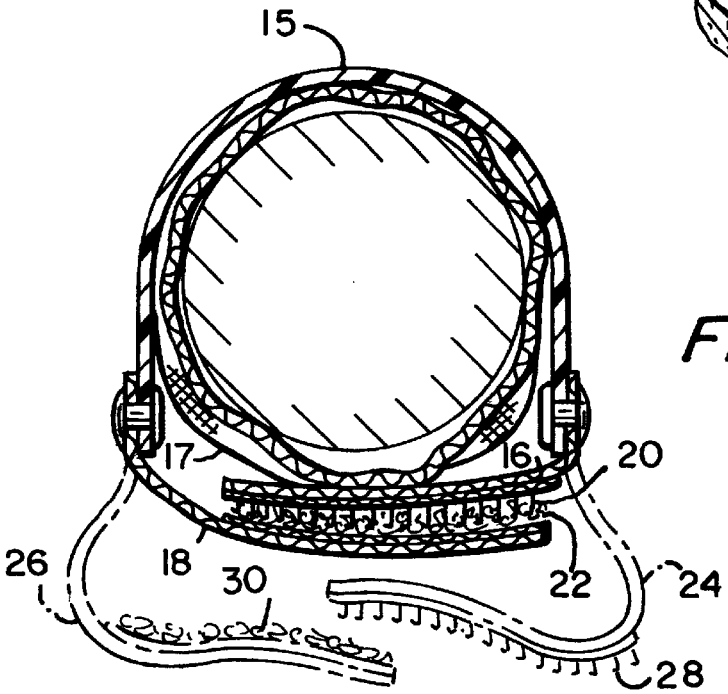
FIG. 2

TOTAL IMPACT FOREARM AND HAND SHIELD

BACKGROUND OF THE INVENTION

A hand-held chisel may be used to accomplish many different tasks. For example, in the masonry trades, a chisel may be used with a hammer to chip out portions of stone, concrete or other hard material to form a groove or other indentation in the workpiece. In the woodworking trades, a chisel may be used with a hammer in similar fashion to chip out portions of wood to form a design. A chisel may also be used in the electric power, plumbing and metalworking trades to tighten or loosen a nut on a corroded bolt or to pull a joint apart. A chisel may further be used to "pop" a rivet off of a steel girder, to break off a weld or to pry apart two pieces of metal bolted together, such as parts attached to an automobile engine block.

Occasionally, while a worker is using a hammer in an attempt to strike the chisel, the worker will miss the top of the chisel and strike his or her forearm or hand with the hammer, thus causing great pain and sometimes serious injury. No matter how careful the worker is in swinging the hammer, the worker is likely to miss the top of the chisel once in a while because of the relatively small surface areas of the chisel top and hammer end. Therefore, a need exists in the masonry, woodworking, metalworking, plumbing, electric power and other trades for a shield of some sort to protect the forearm and hand of a person from hammer blows that go astray during chiseling.

A number of shields have been developed in the prior art for the protection of specific body parts from flying objects, sunlight, extreme cold, extreme heat, or for other specialized purposes. For example, U.S. Pat. No. 5,566,390 discloses a shield for protecting the back of the hand from sunlight. U.S. Pat. No. 4,657,282 discloses a ski pole hand shield for protecting the hand from the cold. Also, U.S. Pat. No. 5,641,934 shows a see-through hand-held bullet-resistant shield for protecting the upper body from bullets, rocks or other objects. And U.S. Pat. No. 5,159,759 shows a debris shield for protecting a person from debris created by operation of a power saw. However, a shield suitable for protecting the forearm and hand from hammer blows during chiseling has heretofore not been available.

SUMMARY OF THE INVENTION

The general purpose of the present invention, which will be described subsequently in greater detail, is to provide a new one-piece, lightweight shield that is not anticipated, rendered obvious, suggested or implied by any of the prior art shields, either alone or in combination.

To attain this, the present invention comprises a one-piece shell for covering the top half of a person's extended forearm and the entire hand clenched around a chisel or other tool. An opening is formed in the shield near the hand end to allow a chisel to be grasped by the person's hand while wearing the shield. Straps are provided on the lower, open part of the shell to attach the shield to the forearm. The shield may be made of shatter-resistant plastic or other durable, lightweight material. In a preferred embodiment, the shield is transparent to allow the user to see the top of the chisel, in order to maximize the accuracy of the person's aim while he or she swings a hammer held in the other hand and strikes the top of the chisel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood when consideration is given to the following detailed description thereof. Such description makes reference to the annexed drawings wherein:

FIG. 1 is a top perspective view of the shield of the present invention, shown with the shield in place over a person's hand and forearm.

FIG. 2 is an end view of the present invention, taken along section 2—2 of FIG. 1.

DETAILED DESCRIPTION OF THE PREFERRED EMBODIMENT

Figure 3:
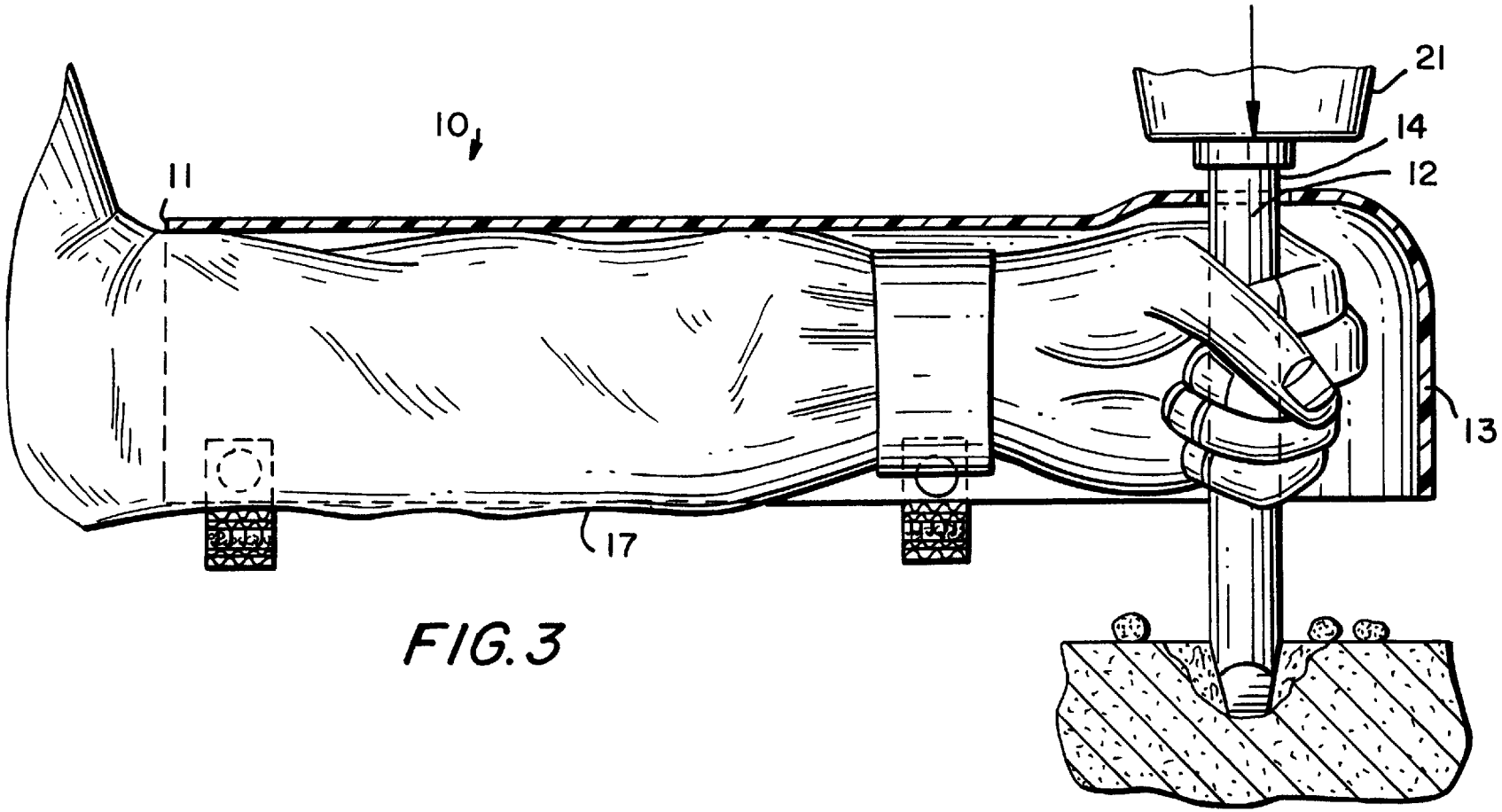
FIG. 3 is a side view of the present invention in place over a person's hand and forearm, looking at point 3 of FIG. 1.

Turning now to the drawings, FIG. 1 shows a top perspective view of one embodiment of the shield of the present invention. The shield comprises a one-piece shell 10 of generally half-tubular in shape with a closed, rounded top half 15 and an open bottom half 17. Such shape is also illustrated in FIG. 3. Shell 10 is of a size and shape suitable for fitting snugly over the extended forearm and clenched fist, with thumb wrapping around the fingers, of an average-sized person. The illustration of FIG. 1 shows a shell 10 shaped to fit the left forearm and hand, but such a shield may easily be modified to fit the right forearm and hand instead.

In a preferred embodiment, shell 10 is comprised of shatter-resistant and crack-resistant plastic, such as plexiglass, but any other lightweight material may be used in the alternative, such as fiberglass or aluminum. The material should be hard enough to withstand the total impact of a fully-swung steel hammer 21 or other hand-held construction, stoneworking, woodworking or metalworking tool.

Shell 10 is preferably transparent, to allow the user to see a tool being held in the hand. For example, it is important for the user to be able to see the top of a chisel 14, so that a hammer being held in the other hand can be swung to strike the chisel straight on, in order to transmit the most force to the cutting end of the chisel. The shell is preferably ¼ inch to ⅜ inch thick.

As shown in FIGS. 1 and 3, shell 10 has an elbow end 11 and a hand end 13. Elbow end 11 is squared-off and open, to fit snugly against a person's upper forearm. Hand end 13 is rounded and closed to surround all fingers of the hand that may be clenched into a fist around a tool, such a chisel 14. Top half 15 of shell 10 also preferably contains an opening 12, near hand end 13. Opening 12 is of generally circular shape and positioned so as to lie above the V-shaped opening between the thumb and forefinger of a clenched fist. Opening 12 preferably has a diameter slightly larger than the largest cross-sectional diameter of a standard metal chisel 14, so as to permit such chisel to easily slide through top half 15 of shell 10 and to be grasped in the hand.

In a preferred embodiment, shell 10 is attached to the forearm by means of two or more pairs of straps 16, 18, 24 and 26. (See FIG. 2.) These straps may be made of leather, cloth, or other flexible material. Each strap has at its respective end an area 20, 22, 28, 30 that is covered with velcro(®) material for fastening the two ends of each pair together. In the alternative, each strap may contain at its respective end a metal, plastic or other buckle or other fastener for attaching the ends of each pair together.

In use, the shield 10 of the present invention is placed over the top of the extended forearm and hand of a person prior to the use of a tool such as chisel 14 of FIG. 1. If the person is right-handed, the shield would be placed over the left forearm and hand, and vice versa. Shield 10 is securely attached to the forearm by means of straps 16, 18 and 24, 26. Chisel 14 is passed through opening 12 and grasped in the person's clenched fist, with thumb wrapped around the fingers. At this point, the person is now safe to begin striking the top of chisel 14 with a steel or other hammer 21 swung using the full strength of the person's opposite hand and arm, in order to work on a stone, wood, metal or other workpiece 32. Hammer blows that accidentally miss the top of chisel 14, or other total impacts to shield 10, are safely absorbed or deflected by shield 10.

The foregoing is considered as illustrative only of the principles of the invention. Further, since numerous modifications and changes will readily occur to those skilled in the art, it is not desired to limit the invention to the exact construction shown, and accordingly, all suitable modifications and equivalents may be resorted to, falling within the scope of the invention.

I claim:

1. A forearm and hand shield comprising:

a one-piece, curved shell formed into a substantially half-cylindrical shape suitable for covering the top of a person's extended forearm and around such person's fist holding a chisel with thumb over fingers;

such shell having an upper portion and a lower portion, and an elbow end and a hand end;

such lower portion suitable to fit snugly over such forearm and hand; and such upper portion containing, near such hand end, an opening substantially circular in shape wherein such shield is comprised of a shatter-resistant, crack-resistant and transparent plastic material.

* * * * *